US006786371B2

(12) United States Patent
Horneman

(10) Patent No.: US 6,786,371 B2
(45) Date of Patent: Sep. 7, 2004

(54) LADDER CARRYING DEVICE

(75) Inventor: Kevin Horneman, 93 Hertzog School Rd., Mertztown, PA (US) 19539

(73) Assignee: Kevin Horneman, Mertztown, PA (US)

( * ) Notice: Subject to any disclaimer, the term of this patent is extended or adjusted under 35 U.S.C. 154(b) by 97 days.

(21) Appl. No.: 10/206,723

(22) Filed: Jul. 25, 2002

(65) Prior Publication Data

US 2003/0047574 A1 Mar. 13, 2003

Related U.S. Application Data

(60) Provisional application No. 60/307,745, filed on Jul. 25, 2001.

(51) Int. Cl.[7] ..... E06C 7/00

(52) U.S. Cl. ..... 224/264; 182/129; 224/907

(58) Field of Search ..... 224/264, 265, 224/270, 907; 182/129; 2/459, 460, 461, 462, 268; 206/586, 591, 593, 594

(56) References Cited

U.S. PATENT DOCUMENTS

| | | | | | |
|---|---|---|---|---|---|
| 2,385,315 | A | | 9/1945 | Vanasse | |
| 2,518,107 | A | * | 8/1950 | Wilson | 182/129 |
| 3,050,734 | A | * | 8/1962 | Dopyera | 224/264 |
| 3,248,738 | A | * | 5/1966 | Morgan | 2/462 |
| 3,500,472 | A | * | 3/1970 | Castellani | 2/462 |
| 3,788,308 | A | * | 1/1974 | Simpson | 224/264 |
| 4,431,041 | A | * | 2/1984 | Leiserson | 224/264 |
| 4,474,386 | A | | 10/1984 | Kanemaki | |
| 4,887,318 | A | * | 12/1989 | Weinreb | 224/264 |
| 5,058,789 | A | | 10/1991 | Piper | |
| 5,207,364 | A | | 5/1993 | Johnson | |
| D372,989 | S | | 8/1996 | Gile et al. | |
| 5,551,614 | A | | 9/1996 | Ham | |
| 6,189,752 | B1 | | 2/2001 | Perry | |
| 2002/0046904 | A1 | * | 4/2002 | Richard | 182/129 |
| 2002/0179657 | A1 | * | 12/2002 | Ladd | 224/265 |

* cited by examiner

*Primary Examiner*—Gary E. Elkins
(74) *Attorney, Agent, or Firm*—Thorp Reed & Armstrong, LLP

(57) ABSTRACT

The present invention provides for a ladder carrying device that can be used to carry a ladder either over or under a carrier's shoulder. The ladder carrying device of the present invention can be mounted in a variety of different positions on the side rails and/or rungs of a ladder, thereby allowing the ladder carrying device to be positioned according to the carrier's preference.

14 Claims, 2 Drawing Sheets

LADDER CARRYING DEVICE

This application claims the benefit under 35 U.S.C. §119(e) of the co-pending provisional application of Ser. No. 60/307,745 entitled "Ladder Carrying Device" filed on Jul. 25, 2001, which is incorporated herein by reference.

FIELD OF THE INVENTION

The present invention relates generally to carrying devices, and more specifically to a device that provides for user comfort and protection from injury when carrying a ladder.

BACKGROUND OF THE INVENTION

A ladder is generally carried by a worker to and from a storage location or vehicle and the place where it is used. A ladder generally is constructed to have a pair of side rails connected by at least one rung. A ladder can be cumbersome and can be difficult to control when it is carried because it can swing, or rise and fall in a variety of directions. If uncontrolled, this movement can injure the worker carrying the ladder. Uncontrolled, unpredictable movement of the ladder can also be dangerous to other people or property in the field of movement of the ladder.

A ladder may be carried either above or below the shoulder. If the ladder is carried above the shoulder, one of the side rails is placed on a carrier's or worker's shoulder with the remainder of the ladder, i.e., the rungs and the opposing side rail, above the carrier's or worker's shoulder. If the ladder is carried below the shoulder, one of the side rails is placed on a carrier's or worker's shoulder with the rungs and the opposing side rail located below the person's shoulder.

In either of the above-described carrying positions, the entire weight of the ladder is borne by the carrier's or worker's shoulder muscles and collarbone, which may cause substantial strain on that area of the body. Also, as the ladder side rail may assume a variety of configurations such as U-shaped or C-shaped, there may be increased discomfort due to uneven contacting of the rail with the carrier's or worker's shoulder area. For example, with U-shaped and C-shaped side rails the edges of the side rail contacts the body but the flat, center area of the side rail does not contact the body. That results in the weight and pressure of the ladder being supported by two narrow places on the carrier's shoulder.

The wrist may also experience strain as the carrier or worker attempts to control the ladder to prevent uncontrolled movements. Ladders can be difficult to balance when carried. If more of the ladder is carried behind the carrier or worker, he may try to compensate by pulling the ladder down in front of him, which can create a strain on his body. A comparable balancing problem can occur if more of the ladder is in front of the carrier or worker.

It can sometimes be difficult to determine the best or optimum support point for carrying a ladder, as it is dependent on the carrier or worker carrying the ladder and the terrain. Some carriers or workers contend the best support point for a ladder is at its center of balance or slightly ahead of its center of balance. At the center of balance, the carrier or worker can determine whether or not the ends of a ladder are moved up or down. If the support point is in front of the center of balance of the ladder, the front of the ladder will not fall and dig into the ground, which can injure the carrier or worker carrying the ladder. However, using this support position causes the back end of the ladder to touch the ground and scrape along as the carrier or worker moves forward, which can cause more uncontrolled movement of the ladder. Generally, the carrier or worker carrying the ladder does other physical work after putting the ladder in place, so that it is prudent to conserve his energy and strength. Various attempts have been made to alleviate the above-mentioned problems encountered in carrying ladders.

U.S. Pat. No. 5,058,789 describes a device consisting of a base plate with flanges for attachment around a ladder rail. The base plate has cushions attached to each side to protect the carrier's shoulder from injury. This device interposes another piece of metal with flanges between the person and the ladder. Those flanges can painfully contact the worker's shoulder in a manner described above with regard to the U-shaped and C-shaped rails.

U.S. Pat. No. 5,511,285 describes another ladder carrying device that provides a handle for the side rail of the ladder. This device has the disadvantage that considerable strain can be exerted on arm and back muscles. Further, if the ladder has to be raised over rough terrain or obstacles present in the path of movement, the ends of the ladder can contact the terrain or obstacles. Further exertion can be required by the person carrying ladder to raise the ladder.

U.S. Pat. No. 6,189,752 describes a ladder carrying device that consists of a rigid frame and a cushion pad. Part of the rigid frame contacts the ladder rail and the part of the frame that contacts the person's shoulder has a cushion to provide user comfort. This device has the disadvantage of requiring a rigid frame, which may, through repeated use, break through the cushion and painfully contact the carrier's shoulder.

Therefore, a need exists in the art for a ladder carrying device that will overcome the disadvantages listed above and permits a person to carry a ladder supported on his shoulder in comfort and which will distribute the weight of the ladder over the shoulder area.

SUMMARY OF THE INVENTION

The present invention provides for such a ladder carrying device that can be used to carry a ladder on a carrier's or worker's shoulder positioned either over or under his shoulder. The ladder carrying device of the present invention can be mounted in a variety of different positions on the side rails and/or rungs of a ladder, thereby allowing the ladder carrying device to be positioned according to the carrier's preference.

One embodiment of the present invention is directed to a ladder carrying device for carrying a ladder with two side rails and rungs therebetween over or under a shoulder of a carrier in which the ladder carrying device has at least one block and an adhesive strip to attach the block to the ladder such that the block is positioned between the ladder and the carrier's shoulder.

Another embodiment of the present invention is directed to a ladder carrying device for carrying a ladder having a first side rail and a second side rail, wherein the first and second side rails each have an inner surface and an outer surface and wherein the first and second side rails are connected by a plurality of rungs located therebetween and attached to the inner surfaces of the first and second side rails. The ladder carrying device has a first block having an adhesive strip to position the first block on the inner surface of the ladder's first side rail between an upper rung and a lower rung. The ladder carrying device also has a second block having an adhesive strip to position said second block opposite the first block on the inner surface of the ladder's second side rail between the upper rung and the lower rung. Finally, the ladder carrying device has a third block having an adhesive strip to position the third block on the bottom side of the upper rung adjacent to both the first block and the second block.

These and other advantages and benefits of the present invention will be apparent from the Detailed Description of the Invention herein below.

BRIEF DESCRIPTION OF THE DRAWINGS

The present invention will now be described for the purpose of illustration and not limitation in conjunction with the following figures wherein.

DETAILED DESCRIPTION OF THE INVENTION

Figure 1:
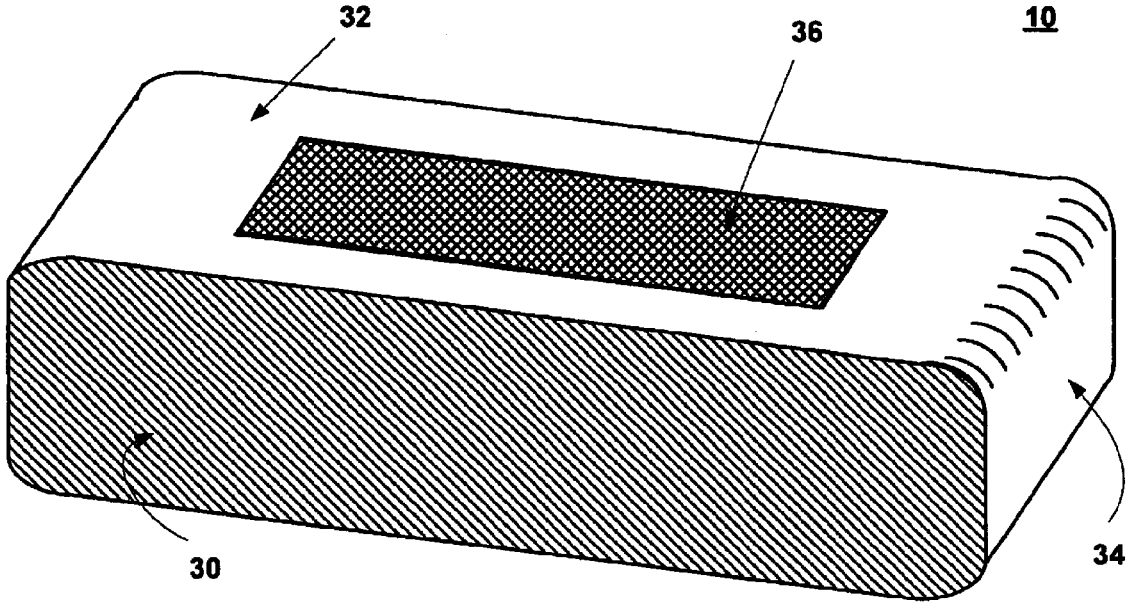
FIG. 1 is a perspective view of one embodiment of the ladder carrying device of the present invention.
Figure 3:
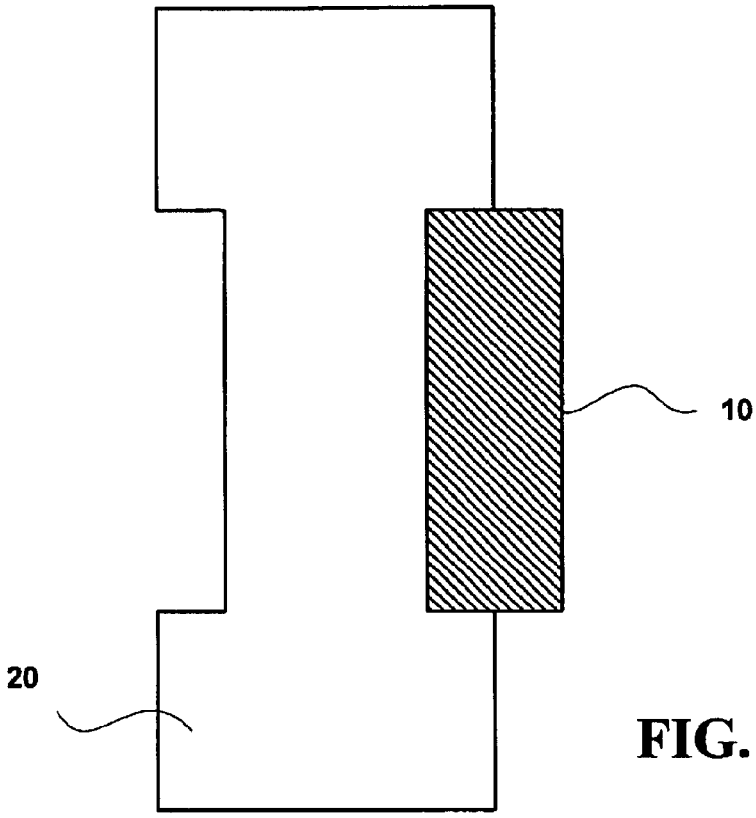
FIG. 3 is a cross-sectional view of a section of a C-shaped side rail having one embodiment of the ladder carrying device of the present invention attached to the inner surface of the side rail.

As shown in FIG. 1, one embodiment of the ladder carrying device 10 of the present invention comprises a rounded, rectangular block. Preferably, this block may be fashioned from a variety of plastic foams such as polyurethane, rubber, or any other material, which has sufficient resiliency to support the weight of the ladder 15, but which also can conform to the contour of the carrier's shoulder. Plastic foams allow the ladder carrying device 10 to act as a cushion against the carrier's shoulder. As shown in FIG. 3, a cushioning ladder carrying device 10 serves two purposes, particularly when used with ladders 15 having C-shaped and U-shaped side rails 20 and/or rungs 25: (1) the block creates a broader surface that contacts with the carrier's shoulder resulting in a more even distribution of weight and pressure across the carrier's shoulder and eliminating the narrow pressure points created by the C-shaped and U-shaped side rails and/or rungs; and (2) the plastic foam provides a cushioned surface that increases the carrier's comfort when carrying and maneuvering the ladder 15.

The present invention 10 also encompasses a block comprised of a non-cushioning material such as a hard plastic or fiberglass. Such a material would not offer the cushioning effect of the softer plastic or plastic foam, but would serve the remaining purpose of creating a broader, flat surface in contact with the carrier's shoulder. Again, the creation of a broader contact area decreases the discomfort caused by C-shaped and U-shaped side rails 20 (see FIG. 3) and rungs 25 by more evenly distributing the weight and pressure of the ladder 15 across the carrier's shoulder.

Most ladders 15 are constructed so as to have similar dimensions. Generally, rungs 25 are spaced approximately twelve inches apart from one another. Most ladders 15 have side rails 20 that are three to four inches wide. For most C-shaped and U-shaped side rails 20 the depth of the C-shape or U-shape (or the depth of the edges of the C-shape or U-shape) is approximately one and a quarter inches to one and a half inches. Generally, the block of the present invention 10 will be eight to thirteen inches in length, one and a half to three inches in thickness, and two to five inches in width. In the preferred embodiment, the block would be produced from high-density foam rubber or plastic foam and would measure approximately ten to twelve inches in length, approximately two inches in thickness, and approximately three to four inches in width. It will be obvious to one skilled in the art though, that the present invention can be dimensioned and shaped to fit the specific dimensions of any ladder 15, side rail 20, or rung 25, regardless of the size and shape of the ladder 15, side rail 20, and rung 25.

Figure 2:
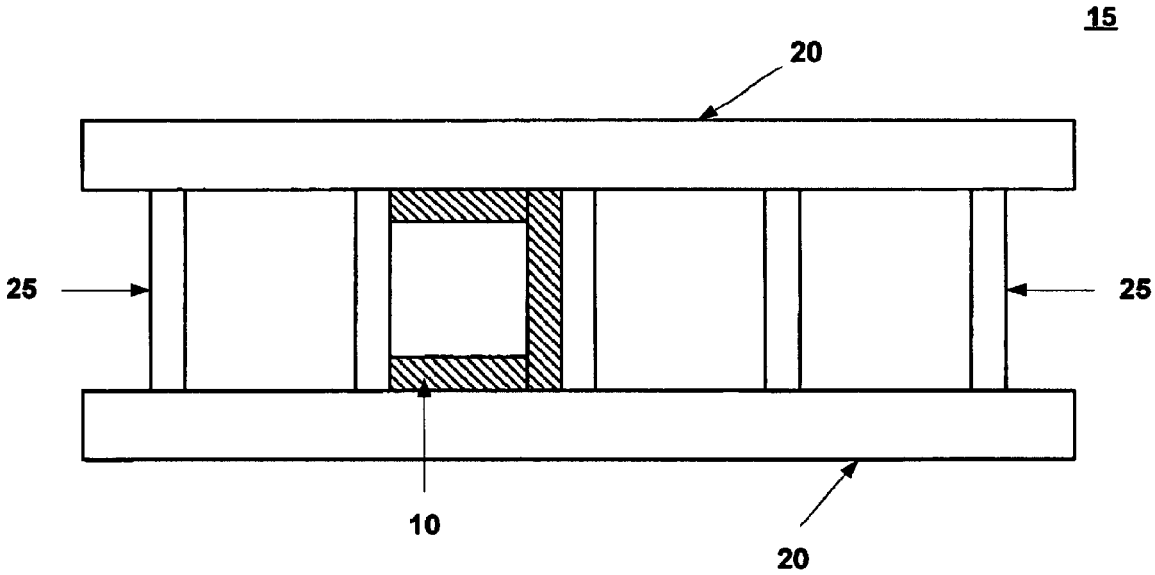
FIG. 2 illustrates one embodiment of the ladder carrying device of the present invention attached to a ladder.

The ladder carrying device 10 of the present invention comprises a front face 30, a top face 32, and a side face 34. Rear, bottom and opposite side faces are not shown in FIG. 1. Top face 32 preferably has adhesive strip 36 affixed thereto. Adhesive strip 36 can be used to attach the ladder carrying device 10 of the present invention to the ladder 15 as illustrated in FIG. 2. Although depicted herein as a rounded, rectangular block, it will be apparent to those skilled in the art that the ladder carrying device 10 of the present invention can be sized and shaped to fit a wide variety of ladders 15 and may therefore assume other shapes than illustrated, such as squares or ovals.

In the preferred embodiment, the present invention will be attached to the ladder 15 near its center of gravity, but one skilled in the art will realize that the blocks can be placed in any one location or multiple locations depending on the user's preference, such as on the inner surface of a side rail 20 (see FIG. 2), on the outer surface of a side rail 20 (see FIG. 4), and/or on the bottom surface of a rung 25 (see FIG. 2). FIG. 2 illustrates one possible configuration of the ladder carrying device 10 of the present invention. This configuration can be attached to a ladder 15 to provide user comfort and protection against injury from the ladder's 15 side rail 20 coming into direct contact with the carrier's shoulder. As depicted in FIG. 2, ladder 15 is composed of side rails 20 connected by rungs 25. Three ladder carrying devices 10 of the present invention are attached by adhesive strips 36 to the inner portion of the side rails 20 and the bottom portion of one rung 25. This method of placement allows the carrier to carry the ladder 15 in the below the shoulder position described above. Placing a ladder carrying device 10 of the present invention on the lower portion of the rung 25 permits the worker to comfortably move the ladder 15 in a vertical orientation, such as when the ladder 15 is leaning against a building.

Figure 4:
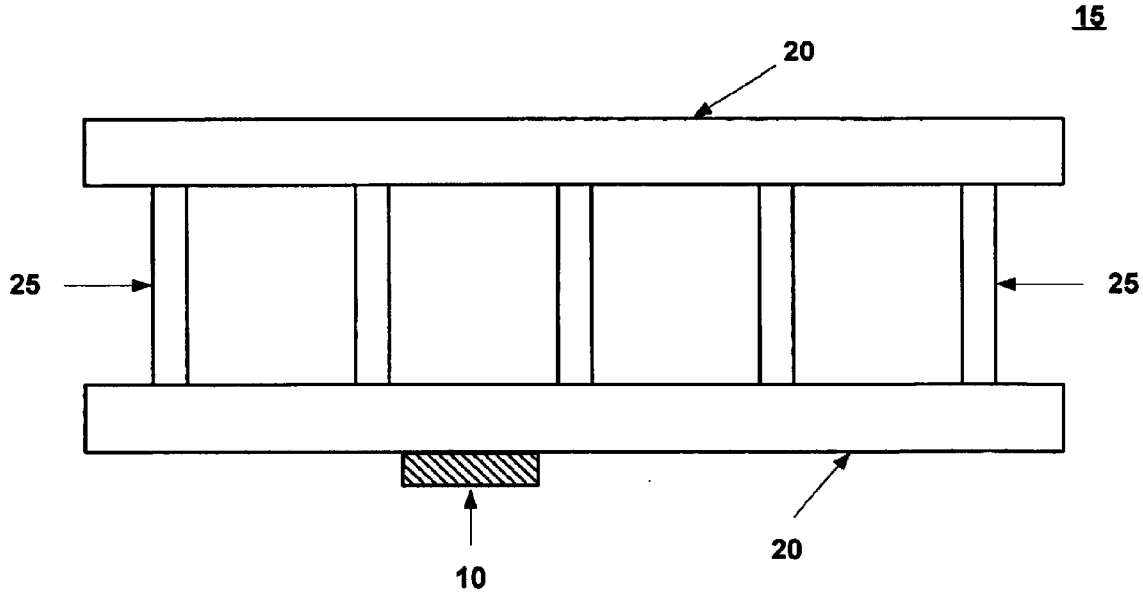
FIG. 4 illustrates one embodiment of the ladder carrying device of the present invention attached to the outer surface of a side rail.

In another embodiment, the ladder carrying device 10 of the present invention can be attached to the outer surface of a ladder side rail 20 (as shown in FIG. 4) thereby enabling the carrier to utilize the over the shoulder carrying method described above.

The ladder carrying device 10 of the present invention can be quickly and easily applied by the user at the particular location on the ladder 15 that he prefers and can be used on a wide variety of ladders 15 to allow for safe, comfortable carrying. Because the user is protected from pain and strain from carrying the ladder 15, he may also be able to exert greater control over the ladder 15 thereby becoming less hazardous to himself and the people and property around him.

As will be apparent to those skilled in the art, the ladder carrying device 10 of the present invention can be used with ladders 15 having side rails 20 of a variety of configurations including, but not limited to, flat, C-shaped, and U-shaped. Similarly, it will be apparent to those skilled in the art that the ladder carrying device 10 of the present invention can be used with ladders 15 having rungs 25 of a variety of configurations, including but not limited to flat, rounded, C-shaped, and U-shaped. Other embodiments using different numbers of ladder carrying devices 10 of the present invention in various configurations are also contemplated by the inventor.

What is claimed is:

1. A ladder carrying device for carrying a ladder having a first side rail and a second side rail, wherein the first and second side rails each have an inner surface and an outer surface and wherein the first and second side rails are connected by a plurality of rungs located therebetween and attached to the inner surfaces of the first and second side rails, comprising:

a first block having an adhesive strip to position said first block on the inner surface of the ladder's first side rail between an upper rung and a lower rung;

a second block having an adhesive strip to position said second block opposite said first block on the inner surface of the ladder's second side rail between the upper rung and the lower rung; and a third block having an adhesive strip to position said third block on the bottom side of the upper rung adjacent to both said first block and said second block.

2. The ladder carrying device of claim 1, wherein said first block, said second block, and said third block are comprised of plastic foam.

3. The ladder carrying device of claim 2, wherein said first block, said second block, and said third block are comprised of a high-density plastic foam.

4. The ladder carrying device of claim 2, wherein said first block, said second block, and said third block are comprised of a polyurethane.

5. The ladder carrying device of claim 2, wherein said first block, said second block, and said third block are comprised of rubber.

6. The ladder carrying device of claim 1, wherein said first block, said second block, and said third block are comprised of fiberglass.

7. The ladder carrying device of claim 1, wherein at least one of said first block, said second block, and said third block comprise a rectangular block with rounded corners.

8. A ladder carrying device for carrying a ladder having a first side rail and a second side rail, wherein the first and second side rails each have an inner surface and an outer surface and wherein the first and second side rails are connected by a plurality of rungs located therebetween and attached to the inner surfaces of the first and second side rails, comprising:

a first block having an adhesive strip to position said first block on the inner surface of the ladder's first side rail between an upper rung and a lower rung;

a second block having an adhesive strip to position said second block on the bottom side of the upper rung adjacent to said first block.

9. The ladder carrying device of claim 8, wherein said first block and said second block are comprised of plastic foam.

10. The ladder carrying device of claim 9, wherein said first block and said second block are comprised of a high-density plastic foam.

11. The ladder carrying device of claim 9, wherein said first block and said second block are comprised of a polyurethane.

12. The ladder carrying device of claim 8, wherein said first block and said second block are comprised of rubber.

13. The ladder carrying device of claim 8, wherein said first block and said second block are comprised of fiberglass.

14. The ladder carrying device of claim 8, wherein at least one of said first block and said second block comprise a rectangular block with rounded corners.

* * * * *